US006943305B2

(12) United States Patent
Kawamura et al.

(10) Patent No.: US 6,943,305 B2
(45) Date of Patent: Sep. 13, 2005

(54) SWITCH DEVICE

(75) Inventors: Takashi Kawamura, Fukuoka (JP); Tetsuya Nakamura, Fukuoka (JP)

(73) Assignee: Mitsumi Electric Co., Ltd., Tokyo (JP)

( * ) Notice: Subject to any disclaimer, the term of this patent is extended or adjusted under 35 U.S.C. 154(b) by 0 days.

(21) Appl. No.: 10/880,090

(22) Filed: Jun. 30, 2004

(65) Prior Publication Data

US 2005/0067263 A1 Mar. 31, 2005

(30) Foreign Application Priority Data

Sep. 29, 2003 (JP) ..... P. 2003-338798

(51) Int. Cl.[7] ..... H01H 9/00
(52) U.S. Cl. ..... 200/4; 200/6 A; 200/5 R
(58) Field of Search ..... 200/4, 6 A, 5 A, 200/5 R, 6 R, 17 R, 18, 11 R, 11 A, 11 D, 11 DA, 11 E, 11 K, 11 TW

(56) References Cited

U.S. PATENT DOCUMENTS 5,621,196 A * 4/1997 Nishijima et al. ..... 200/6 A
5,744,765 A * 4/1998 Yamamoto ..... 200/6 A
6,162,999 A * 12/2000 Ishikawa et al. ..... 200/6 A
6,229,103 B1 * 5/2001 Yamamoto et al. ..... 200/4
6,236,002 B1 * 5/2001 Chou ..... 200/4
6,534,730 B2 * 3/2003 Ohmoto et al. ..... 200/4
6,642,459 B2 * 11/2003 Chou et al. ..... 200/11 TW
6,680,444 B1 * 1/2004 Lee ..... 200/4

FOREIGN PATENT DOCUMENTS

JP 9-63420 3/1997
JP 2001-143577 5/2001

* cited by examiner

*Primary Examiner*—Elvin Enad
*Assistant Examiner*—M. Fishman
(74) *Attorney, Agent, or Firm*—Whitham, Curtis & Christofferson, P.C.

(57) ABSTRACT

A switch device includes a base member, an operation member conducting a rotating operation in a first direction and a second direction, a pushing operation in a third direction, and a tilting operation in forward and backward directions, an urging member which urges the operation member constantly so that the operation member is restored to a reference position, a first and a second switches which are operated by the rotating operation of the operation member in the first and second directions, a third switch, which is operated by the pushing operation of the operation member; and a fourth and a fifth switches which are operated by the tilting operation in the forward and backward direction of the operation member. The first, second and third directions is parallel to a surface or the base member. The forward and back ward directions are perpendicular to the surface of the base member.

8 Claims, 5 Drawing Sheets

SWITCH DEVICE

BACKGROUND OF THE INVENTION

The present invention relates to a switch device. More particularly, the present invention relates to a composite operation type switch device capable of conducting five different operations with one operation member and also capable of outputting an electric signal for each operation.

Concerning the composite operation type switch device which is used as a part for inputting signals into an electronic apparatus such as a video camera, digital camera, audio CD player or cellular phone, a plurality of switches must be smoothly, continuously operated so as to conduct a predetermined processing.

In order to meet the above demand, JP-A-9-63420 discloses a switch device in which two different switching operations can be conducted by the rotary operation of one operation switch in such a manner that the first switch is operated when a single operation member is rotated to the left and the second switch is operated when the single operation member is rotated to the right. Further, JP-A-2001-143577 discloses a switch device in which three different switching operations can be conducted by the rotary operation of a single operation switch in such a manner that the first switch is operated when the single operation member is rotated to the right and the second switch is operated when the single operation member is rotated to the left and the third switch is operated when the single operation member is pushed.

As described above, according to the switch device described in JP-A-9-63420, contact points of two different switches can be changed by the operation of the single operation member. According to the switch device described in JP-A-2001-143577, contact points or three different switches can be changed by the operation of the single operation member. However, in order to use the switch devices as parts for inputting data into multi-functional information apparatus recently developed, the switching number of two or three is not sufficiently large for the multi-functional switch use. In the case where a composite operation type switch device, the contact point switching number of which is small, is used as a part for inputting data, it is impossible to conduct various types of operation by the composite operation type switch device. Therefore, a plurality of switch devices are needed to conduct various types of operation. However, when a plurality of switch devices are used for a mobile information apparatus, the size or the apparatus is increased.

SUMMARY OF THE INVENTION

It is therefore an object or the present invention to provide a switch device in which the contact point switching number of one operation member to be more than three is increased so that various types of operation can be conducted by one operation member.

In order to achieve the above object, according to the present invention, there is provided a switch device, comprising:

a base member;

an operation member, which is provided on the base member, and which conducts a rotating operation in a first direction and a second direction opposed to the first direction, a pushing operation in a third direction, and a tilting operation in forward and backward directions;

an urging member, which urges the operation member constantly so that the operation member is restored to a reference position;

a first and a second switches, which are operated by the rotating operation of the operation member in the first and second directions;

a third switch, which is operated by the pushing operation of the operation member, and a fourth and a fifth switches, which are operated by the tilting operation in the forward and backward direction of the operation member, wherein the first, second and third directions is parallel to a surface of the base member; and wherein the forward and back ward directions are perpendicular to the surface of the base member.

According to this constitution, when the operation member is rotated to the first or second direction, the first or the second switch is operated. When the operation member is pushed in, the third operation switch is operated. When the operation member is operated being tilted in the forward or the backward direction, the fourth or the fifth switch is operated. In the related switch device, the switching number of the contact points capable or being operated by one operation member is three. However, according to the switch device of the present invention, the switching number of the contact points capable of being operated by one operation member is five.

Preferably, the switch device further includes a slide member which is slideably provided on the base member, and a rotary member which is rotatably attached to the slide member. The slide member slides on the base member with the rotary member when the pushing operation is conducted to change the third switch. The rotary member rotates with the operation member in the first and second directions when the rotary operation is conducted to change the first and second switches according to the rotating direction.

According to this constitution, when the operation member is operated being pushed in, the slide member is slid integrally with the operation member, and the third switch is changed via the slide member. When the slide operation member is rotated to the first or second direction, the rotary member is rotated to the first or second direction in the same manner as the operation member, so that the first or the second switch can be changed according to the rotating direction of the rotary member.

Preferably, the operation member has an intermediate portion which is rotatably and tiltably attached to the rotary member, the intermediate portion serving as a fulcrum when the operation member is tilted in the forward and backward direction. The intermediate portion has a first end portion and a second end portion which are located at both side of the intermediate portion. When the operation member is tilted in the forward direction, the first end portion pushes the fourth switch so that the fourth switch is changed. When the operation member is tilted in the backward direction, the second end portion pushes the fifth switch so that the fifth switch is changed.

According to this constitution, the operation member can be tilted in the forward and the backward direction round the fulcrum of the intermediate portion. When the operation member is tilted in the forward direction, the end portion of the operation member is pushed by the fourth switch. Due to this pushing motion, the fourth switch is changed. On the contrary, when the operation member is tilted in the backward direction, the second end portion of the operation member is pushed by the fifth switch. Due to this pushing motion, the fifth switch in changed.

Preferably, the base member has a support shaft which is protruded upward. The slide member has a hole which extends in a sliding direction of the slide member. The support shaft is inserted into the hole.

According to this constitution, a movement of the slide member sliding on the base member can be guided by the engagement of the support shaft of the base member with the hole of the slide member.

Preferably, the urging member is provided as a torsion coil spring which has a winding portion and a pair of arm portions extending outside from the winding portion. The winding portion is attached to the rotary member from the above of the operation member. The pair of arm portions are fixed to the base member.

According to this constitution, the operation member can be pushed being returned to the reference position by the torsion coil spring at all times.

Preferably, an electrode pattern for the first and the second switches is provided on the rotary member. A sliding piece coming into contact with the electrode pattern is provided on the slide member. When the operation member is rotated to either the first direction or second direction, a changing operation is conducted between a first electric circuit formed at the time of starting rotation and a second electric circuit formed in a case that the operation member is further rotated in the same direction. The first electric circuit has the slide piece and the electric pattern. The second electric circuit has the slide piece, another slide piece and the electrode pattern.

According to this constitution, when the operation member is rotated to either the first or second direction, a switching operation is conducted between a first electric circuit, in which the slide piece and the electric pattern are closed at the time of starting rotation, and a second electric circuit which is composed of the slide piece, another slide piece and the electrode pattern when the rotation is further conducted in the same direction. Therefore, for example, the rotating speed of an audio CD player can be set at two steps. In other words, when an electric signal generated in the first electric circuit is defined as the first rotating speed signal and an electric signal generated in the second electric circuit is defined as the second rotating speed signal which is twice as fast as the first rotating speed, a strong and weak signal of the rotating speed can be generated by one rotating operation.

Preferably, the base member has a containing portion in which a bottom face and side faces are closed and an upper face is open;

wherein the slide member, the rotary member, the operation member and urging member are contained in the containing portion;

wherein the upper face of the base member is closed so as to cover by a cover member except an operating portion of the operation member for conducting the rotating operation, the pushing operation and the tilting operation.

According to this constitution, the containing portion, the bottom face and the side face of which are closed, is formed on the base member, the upper face of which is covered with a cover member, and the slide member, the rotary member, the operation member and the pushing member are arranged in the containing portion. Accordingly, the bottom face and the side face of the containing portion are closed, and further no gaps are formed on the bottom face and the side face so that flux can not intrude into the containing portion. Therefore, even when reflow solder comes into contact with a lower face of the base member in the case of conducting reflow soldering on the composite operation type switch device, no reflow flux intrudes into the containing portion.

Preferably, the base member has a first engaging portion provided on a side face thereof;

wherein the cover member has a second engaging portion provided on a side edge thereof; and wherein the first engaging portion is engaged with the second engaging portion when the cover member is attached to the base member.

According to this constitution, when the second engaging portion provided on the cover member is slid along side face of the base member, the second engaging portion is engaged with the first engaging portion. Due to this engagement, the cover can be simply attached to the base member while the cover is being prevented from coming out.

In the above configurations, five contact points can be changed by the operation of one operation member. Accordingly, it is possible to conduct various operations by one operation member. Therefore, the composite operation type switch device of the present invention is advantageous in that the number of switches is decreased and the size of the device can be reduced.

Further, in the above configurations, When the operation member is pushed in, the slide member is slid integrally with the operation member, so that the third switch can be changed. When the operation member is operated being rotated to the right or left, the rotary member is rotated to the right or left in the same manner as the operation member, so that the first or the second switch can be changed according to the rotating direction. Accordingly, the rotating and the pushing operation of the operation member can be positively transmitted to the first, the second and the third switch via the slide member or the rotary member.

Further, in the above configurations, when the operation member is tilted in the forward direction, the first end portion of the operation member pushes the fourth switch, so that the fourth switch can be changed. When the operation member is tilted in the backward direction, the second end portion pushes the fifth switch, so that the fifth switch can be changed. Therefore, the fourth and the fifth switch can be smoothly operated being changed.

In the above configurations, when the slide member moves on the base member, it can be guided by the engagement of the support shaft of the base member with the hole of the slide member. Therefore, the slide member can be smoothly slid on the base member in a predetermined sliding direction.

In the above configurations, the torsion coil spring, the structure of which is simple, the manufacturing cost of which is low, is used as the pushing member capable of returning the operation member to the reference position at all times. Therefore, the cost can be reduced, that is, the price can be lowered.

In the above configurations, two step signal (strong and weak signal) of the rotating speed can be generated by one rotary operation.

In the above configurations, no gaps are formed on the bottom face and the side face, which compose the containing portion of the base member, so that flux can not intrude into the containing portion. Therefore, even when mounting is conducted by the reflow soldering method in which reflow solder is used, no flux of the reflow solder intrudes inside.

Accordingly, it is possible to obtain a composite operation type switch device to which the reflow soldering method can be suitably applied.

In the above configurations, when the second engaging portion provided on the cover is slid along the side face of the base member, the second engaging portion is engaged with the first engaging portion of the base member. Due to this engagement, the cover member can be simply attached to the base member while the cover member is being prevented from coming out. Therefore, the assembling work can be simplified.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

In order to accomplish an object of obtaining the structure in which the contact point switching number, which can be changed by one operation member, is increased to be more than three, the composite operation type switch device is composed as follows. The first and the second switch, which are operated by the rotation to the right and left of one operation member, the third switch, which is operated by the pushing operation of the operation member and the fourth and the fifth switch, which are operated by the forward and backward tilting operation of the operation member, are provided. When one operation member is rotated to the right or left, the first or the second switch is operated. When the pushing operation is conducted, the third switch is operated. When the tilting operation is conducted in the forward or the backward direction, the fourth of the fifth switch is operated. In this way, five contact points can be changed by one operation member.

Figure 1:
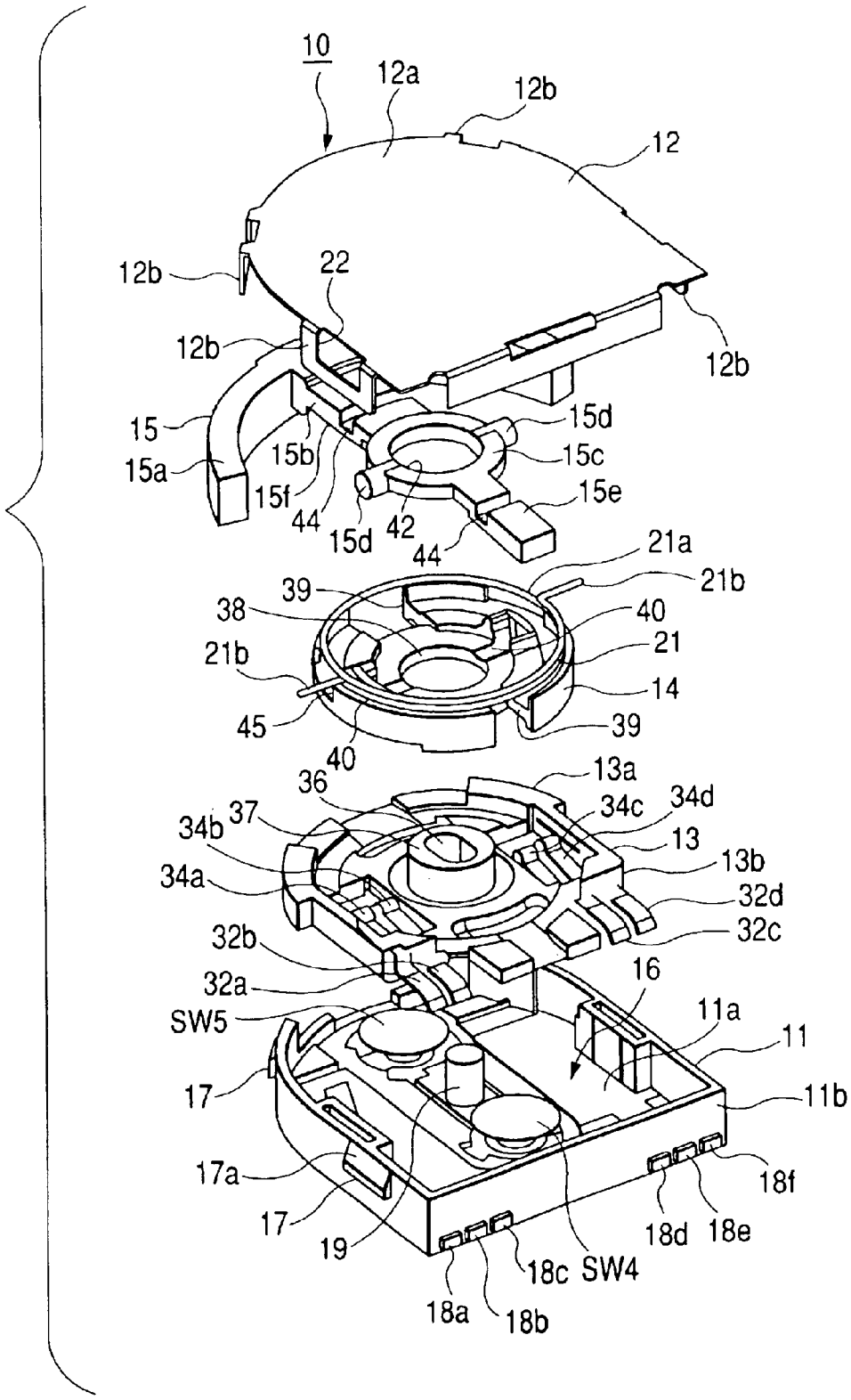
FIG. 1 is an exploded perspective view showing a primary portion of the compound operation type switch device according to an embodiment of the present invention.
Figure 2:
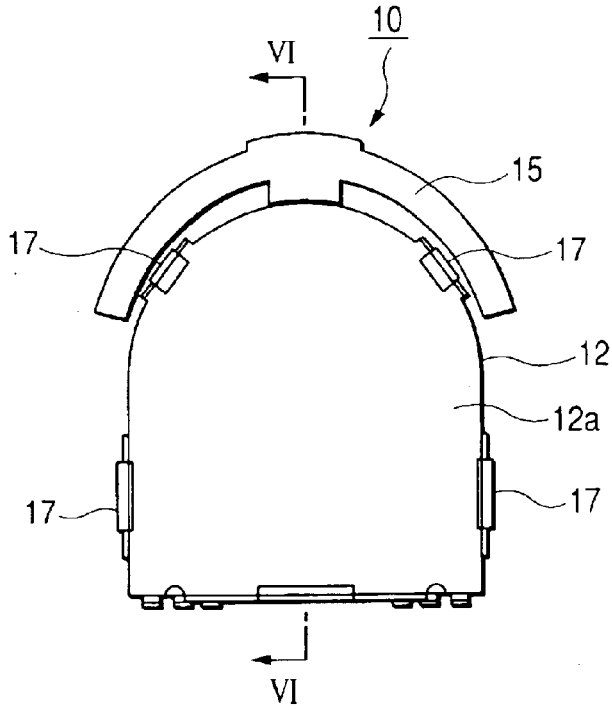
FIG. 2 is a front view of the device or the embodiment.
Figure 3:
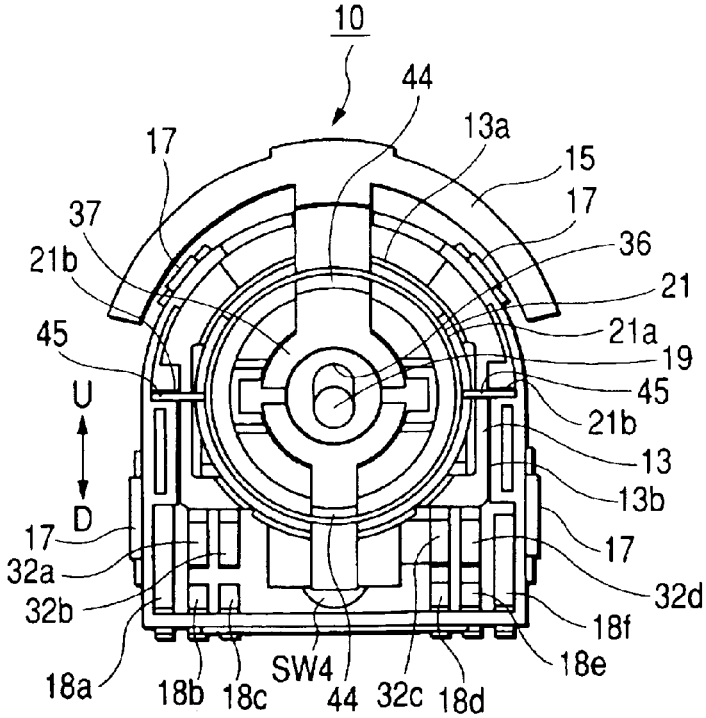
FIG. 3 is a plan view showing an inner structure of the embodiment.
Figure 4:
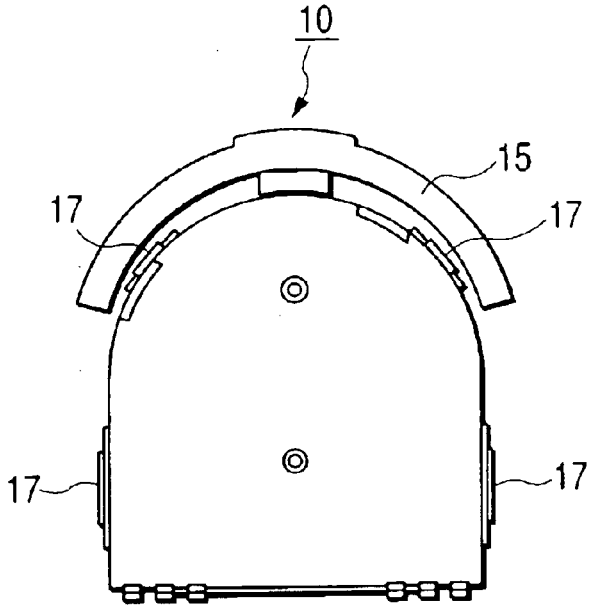
FIG. 4 is a rear view showing a device of the embodiment.
Figure 5:
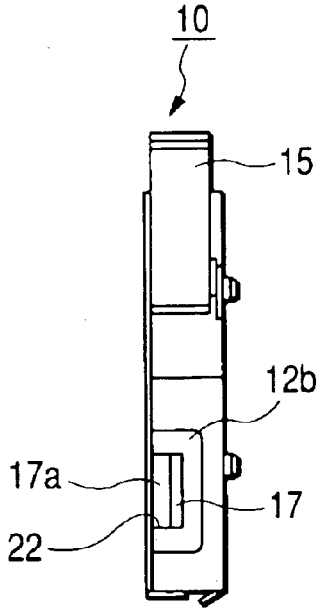
FIG. 5 is a side view showing a device of the embodiment.
Figure 6:
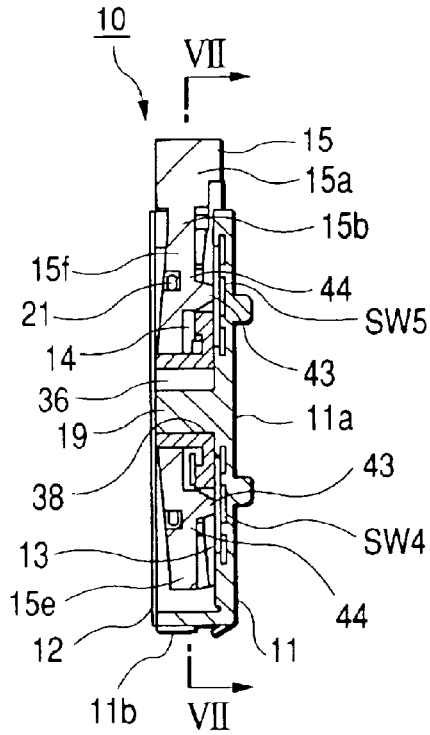
FIG. 6 is a sectional view taken on line VI—VI in FIG. 2.
Figure 7:
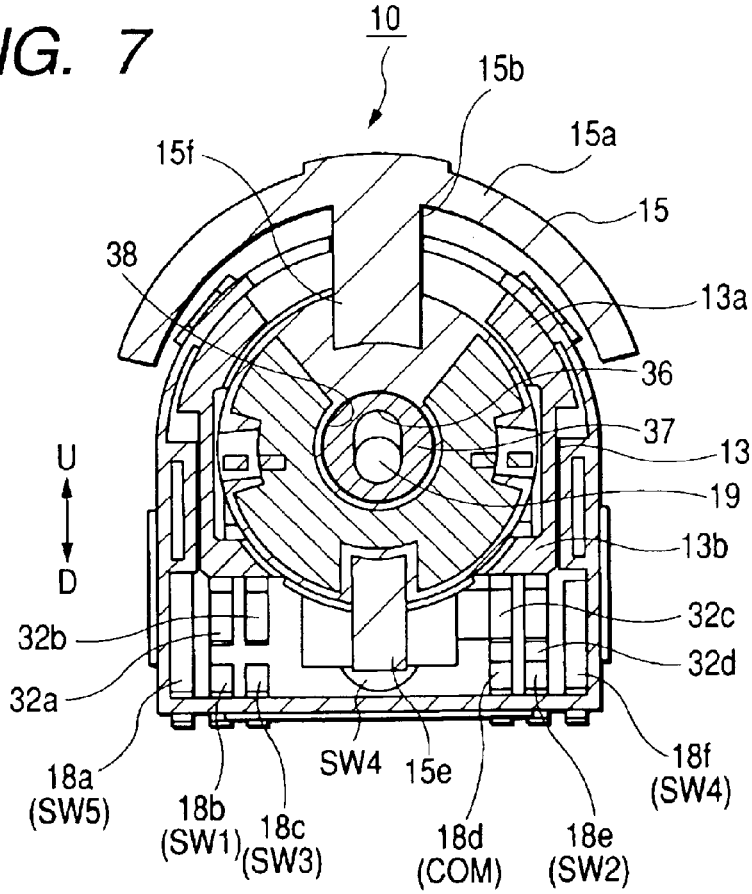
FIG. 7 is a sectional view taken on line VII—VII in FIG. 6.

FIGS. 1 to 7 are views showing the composite operation type switch device according to an embodiment of the present invention. FIG. 1 is an exploded perspective view showing a primary portion of the composite operation type switch device, FIG. 2 is a front view of the composite operation type switch device, FIG. 3 is a plan view showing an inner structure of the composite operation type switch device from which the cover is removed, FIG. 4 is a rear view of the composite operation type switch device, FIG. 5 is a side view of the composite operation type switch device, FIG. 6 is a sectional view taken on line VI—VI in FIG. 2, and FIG. 7 is a sectional view taken on line VII—VII in FIG. 6.

As shown in FIGS. 1 to 7, the composite operation type switch device 10 includes a base 11, a cover 12, a slide member 13, a rotary plate 14 and an operation member 15.

The composite operation type switch device 10 is operated by one operation member 15 so that five operations, which will be described in the following items (1) to (5), can be conducted.

(1) When the operation member 15 is operated so as to rotate to the left, the contact point of the first switch SW1, which is provided between the rotary plate 14 and the slide member 13, is changed between an opened state and a closed state.

(2) When the operation member 15 is operated so as to rotate to the right, the contact point of the second switch SW2, which is provided between the rotary plate 14 and the slide member 13, is changed between an opened state and a closed state.

(3) When the operation member 15 is operated so as to be pushed in, the slide member 13 is slid together with the rotary plate 14, and the contact point of the third switch SW3, which is provided between the slide member 13 and the base 11, is changed between an opened state and a closed state (4) when the operation member 15 is tilted in the forward direction, the contact point of the fourth switch SW4 is operated so as to be changed.

(5) When the operation member 15 is tilted in the backward direction, the contact point or the fifth switch SW5 is operated so as to be changed.

That is, the composite operation type switch device of the present invention is composed in such a manner that the contact points of the five switches SW1 to SW5 can be changed between an opened state and closed state by the operation of one operation member 15.

The structure will be explained in detail as follows.

The base 11 is made of, for example, resin. The base 11 includes a bottom wall 11*a* and a side wall 11*b* substantially perpendicularly protruding upward from the bottom wall 11*a*. Therefore, the containing portion 16 in which the upper face is open, is provided inside the bottom wall 11*a* and the side wall 11*b*. In this connection, the side wall 11*b* is continuously, circularly formed. Due to the above structure, the bottom face and the side face are completely closed by the bottom wall 11*a* and the side wall 11*b*. Accordingly, it is possible to prevent flux from intruding into the containing portion 16 from the lower face side.

On the outer face of the side wall 11*b* of the base 11, four engaging pawls 17, which substantially perpendicularly protrude outside from the side wall 11*b*, are provided. The shape of each pawl 17 is substantially rectangular. In this case, two of the engaging pawls 17 are provided on the right, and the other two of the engaging pawls 17 are provided on the left. The slope 17*a*, which gradually comes to the side wall 11*b* side when it proceeds upward, is formed on the upper face of each engaging pawl 17.

Further, the electrode pattern, on which the stationary contact point elements 18*a*, 18*b*, 18*c*, 18*d*, 18*e*, 18*f* are provided being slenderly extended in the sliding direction (the direction shown by arrow D-U in FIGS. 3 and 7), is formed on the inner face of the bottom wall 11*a* of the base 11. In this connection, the stationary contact point element

18*a* is an element connected to the contact point used for switch SW5. The stationary contact point element 18*b* is an element connected to the contact point used for switch SW1. The stationary contact point element 18*c* is an element connected to the contact point used for switch SW3. The stationary contact point element 18*d* is an element connected to the common contact point (COM). The stationary contact point element 18*e* is an element connected to the contact point used for switch SW2. The stationary contact point element 18*f* is an element connected to the contact point used for switch SW4.

A pin shaped support shaft 19 is protrudingly provided at the substantially central position of the bottom wall 11*a* in the containing portion 16 of the base 11. Further, in the containing portion 16 of the base 11, the fourth switch SW4 is attached on the front side with respect to the support shaft 19 in the sliding direction of the sliding member 13, and the fifth switch SW5 is attached on the rear side with respect to the support shaft 19 in the sliding direction of the sliding member 13. The fourth switch SW4 and the fifth switch SW5 are respectively composed of, for example, a dome-shaped conductive member and a predetermined electrode pattern, wherein the conductive member is arranged on the upper side, that is, the conductive member is arranged on the side corresponding to the operation member 15. When the dome-shaped conductive member is not pushed by the operation member 15, the conductive member is formed into a complete dome-shape and separate from the predetermined electrode pattern, so that the circuit can be maintained being opened. When the dome-shaped conductive member is pushed by the operation member 15 and a ceiling portion of the dome-shape is dented, the dome-shaped conductive member comes into contact with the electrode pattern, so that the circuit can be closed. Signals in these circuit states can be taken out via the stationary contact point elements 18*a* and 18*d*. Further, signals in these circuit states can be taken out via the stationary contact point elements 18*f* and 18*d*.

The cover 12 is composed of a metallic sheet, for example, the cover 12 composed of a metallic sheet made of copper alloy by means of press forming. The cover includes a main body portion 12*a*, the size of which is capable of covering an upper face of the base 11. At positions corresponding to the engaging pawls 17 provided on the base 11, the engaging pieces 12*b* respectively having engaging holes 22 are formed in such a manner that each engaging piece 12*b* is bent at a substantially right angle from the main body portion 12*a* toward the lower side. In this connection, the engaging pieces 12*b* can be elastically deformed.

The slide member 13 includes an annular portion 13*a* and a connecting portion 13*b* crossing the annular portion 13*a*. The annular portion 13*a* is made of resin, and has a substantially annular shape. At the center of the slide member 13, the support shaft 37, in which the elliptical hole 36 slenderly extending in the sliding direction and penetrating in the vertical direction is formed, is protrudingly provided upward. The width of the elliptical hole 36 is substantially the same as the outer diameter of the support shaft 19 of the base 11. The slide member 13 is arranged in the containing portion 16 while the support shaft 19 is being inserted into the elliptical hole 36. Therefore, the slide member 13 is arranged so that it can be slid in the direction of arrow D-U shown in FIGS. 3 and 4 being guided by the support shaft 19 and the elliptical hole 36. The first sliding pieces 32*a*, 32*b*, 32*c*, 32*d*, which are respectively composed of an elastic metallic sheet supported by the cantilever system, are protruded downward from the connecting portion 13*b* to the front in the sliding direction (in the direction of arrow D in FIG. 3). The second sliding pieces 34*a*, 34*b*, 34*c*, 34*d*, which are respectively composed of an elastic metallic sheet supported by the cantilever system, are protruded upward from the connecting portion 13*a* to the rear in the sliding direction (in the direction of arrow U in FIGS. 3 and 7).

In this connection, the first sliding piece 32*a* and the second sliding piece 34*a* are sliding pieces for the first switch SW1. The first sliding piece 32*b* and the second sliding piece 34*b* are sliding pieces for the third switch SW3. The third sliding piece 32*c* and the second sliding piece 34*c* are sliding pieces for the common terminal (COM). The first sliding piece 32*d* and the second sliding piece 34*d* are sliding pieces for the second switch SW2.

Figure 8:
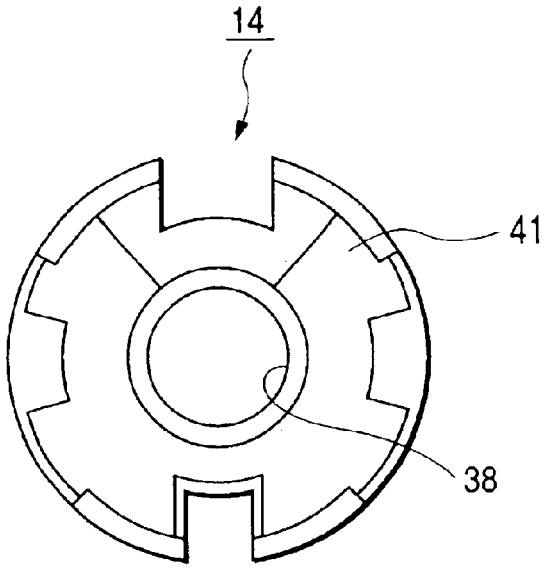
FIG. 8 is a lower face view of the rotary plate of the device of the embodiment.

The rotary plate 14 is a disk-shaped member made of resin. FIG. 8 is a bottom view of the rotary plate 14. As can be seen in FIG. 8, the electrode pattern 41, which is changed while coming into contact with the second sliding pieces 34*a* to 34*d* on the slide member 13, is formed on the lower face of the rotary plate 14. On the other hand, on the upper face of the rotary plate 14, the through-hole 38 capable of accepting the support shaft 37 of the slide member 13 is provided at the center of the rotary plate 14. Further, the bearing groove portions 40 extending in a direction meeting at right angles with the sliding direction of the slide member 13 are formed continuously to the through-hole 38. Furthermore, on the rotary plate 14, the cutout portions 39, 39 are respectively provided in the sliding direction of the slide member 13 at the front and the rear position with respect to the through-hole 38.

The operation member 15 is integrally made of resin and formed into a symmetrical shape in the lateral direction. The operation member 15 includes a base portion 15*a* arranged in the containing portion 16 and an operating portion 15*b* arranged so as to be protruded outside from the base 11. In the intermediate portion 15*c* of the base portion 15*a*, the through-hole 42 capable of accepting the support shaft 37 is provided. Further, in the intermediate portion 15*c* of the base portion 15*a*, the shaft portions 15*d*, 15*d* pivotally attached to the bearing groove portions 40 of the rotary plate 14 are integrally formed. In the front and the rear portion of the operation member 15 with respect to the intermediate portion 15*c*, the thin portions 44 are formed which are groove laterally crossing the base portion 15*a* in the lateral direction.

The pushing operating portions 15*e*, 15*f*, which are portions corresponding to the cutout portions 39 of the rotary plate 14, are protruded downward from the lower face. At positions on the lower face side of the pushing operating portions 15*e*, 15*f* and respectively corresponding to the fourth switch SW4 and the fifth switch SW5, the protruding portion 43, which protrudes straight downward from the lower face, is formed. In this connection, the thin portions 44 are formed on the upper faces of the pushing operating portions 15*e*, 15*f*, that is, on the faces not opposing to the base 11 and at positions between the protruding portion 43 and the intermediate portion 15*c*.

The torsion coil spring 21 is a torsion coil spring composed of a long slender metallic rod member having a spring property. The torsion coil spring 21 includes a winding portion 21*a* and a pair of arm portions 21*b* extending outside from both end portions of the winding portion 21*a* in parallel with the bottom face of the base 11. The torsion coil spring 21 is arranged when it is set into the thin portions 44 of the operation member 15.

Next, assembling of the composite operation type switch device 10 composed as described above will be explained as follows. First of all, the slide member 13 is arranged in the containing portion 16 of the base 11 so that the annular portion 13*a* of the slide member 13 can be set on the rear side (in the direction of arrow U in FIG. 3) in the sliding direction and the connecting portion 13*b* can be set on the front side (in the direction of arrow D in FIG. 3) in the sliding direction. Next, the rotary plate 14 is arranged on the slide member 13 while directing the electrode pattern 41 of the rotary plate 14 downward, and the support shaft 37 is inserted into the through-hole 38. Next, the grooves forming the thin portions 44 are set upward, and the operation member 15 is made to face the upper face of the rotary plate 14. Then, the support shaft 37 is inserted into the through-hole 42, and the pushing operating portions 15*e*, 15*f* are made to correspond to the cutout portions 39, and the operation member 15 is arranged on the rotary plate 14. In the above state, the base portion 15*a* of the operation member 15 is arranged inside the base 11, and the operating portion 15*b* is arranged outside the base 11.

Next, from the above of the sliding member 13, the winding portions 21*a* of the torsion coil spring 21 are made to face the operation member 15, and the winding portions 21*a* are arranged in the grooves composing the thin portions 44. While engaging both arm portions 21*b*, 21*b* to the step portion 45 of the rotary plate 14, they are attached to the inner faces on both sides of the base 11. When the torsion coil spring 21 is attached as described above, the slide member 13 is given a spring forces by which the slide member 13 is moved to the rear side (in the direction of arrow U in FIG. 3) in the sliding direction, via the rotary plate 14 at all times. Due to the foregoing, the slide member 13 and the rotary plate 14 are usually arranged at the rear in the sliding direction, that is, at the reference position. At the same time, the rotary plate 14 and the operation member 15, which are integrally rotated to the right and left, are held at the neutral position being balanced by the engagement of the step portion 45 of the rotary plate 14 with the arm portions 21*b* of the coil spring 21. Therefore, the operation member 15 is held while extending in the sliding direction. When the sliding member 13 is arranged at the reference position, the first sliding pieces 32*a*, 32*c*, 32*d* of the slide member 13 come into contact with the stationary contact point elements 18*b*, 18*d*, 18*e* on the base 11 side, and the first sliding piece 32*b* is separate from the stationary contact point element 18*c* on the base 11 side.

Next, from the above of the rotary plate 14, the cover 12 is attached to the base 11. When the cover 12 is attached to the base 11, the engaging pawls 17 of the base 11 are made to correspond to the engaging pieces 12*b* of the cover 12, and the cover 12 is pushed toward the base 11. When the cover 12 is pushed in this way, the engaging pieces 12*b* are moved along the outside of the side wall 11*b*. In the middle of the movement, end portions of the engaging pieces 12*b* collide with the engaging pawls 17. However, in each engaging pawl 17, the face colliding with the end of the engaging piece 12*b* is formed into the inclined face 17*a*. Therefore, when the engaging pieces 12*b*, collide with the engaging pawls 17, the engaging pieces 12*b* follow the inclined faces 17*a* by the elastic deforming characteristic of themselves so that the engaging pieces 12*b* are bent outside and relieved. When the engaging holes 22 have passed through the engaging pawls 17, the engaging pieces 12*b* are elastically returned, so that the engaging holes 22 are engaged with the engaging pawls 17. Due to this engagement of the engaging holes 22 with the engaging pawls 17, the cover 12 can be prevented from coming out from the base 11. In this way, the assembling work is completed.

In the composite operation type switch device 10 assembled in this way, the slide member 13 is moved to the rear in the sliding direction together with the operation member 15 and the rotary plate 14, that is, the slide member 13 is moved to the reference position described before. When a user picks up the operation portion 15*b* of the operation member 15 with the fingers and rotates the operation portion 15*b* to the right or left, by the engagement of the operation member 15 with the rotary plate 14, the rotary plate 14 is rotated at the position together with the operation member 15 round the fulcrum of the support shaft 37. When the rotary plate 14 is rotated, the step portion 45 of the rotary plate 14 comes into contact with the arm portion 21*b* or 21*c* of the torsion coil spring 21. Therefore, the rotary plate 14 is rotated while the arm portion 21*b* or 21*c* is being elastically deformed and bent. Due to this rotation, positions of the electrode pattern 41 on the reverse side of the rotary plate 14 composing the first switch SW1 or the second switch SW2 and the second sliding pieces 34*a* to 34*d* are changed. Signals generated at this time can be taken out via the first sliding pieces 32*a* to 32*d* and the stationary contact point elements 18*b* to 18*e*. After the operation of the first switch SW1 or the second switch SW2 has been completed, the external force, by which the operation member 15 is rotated, is released. Then, the operation member 15 and the rotary plate 14 are returned to the neutral position by the spring returning force of the torsion coil spring 21 which has been deflected until then.

Figure 9:
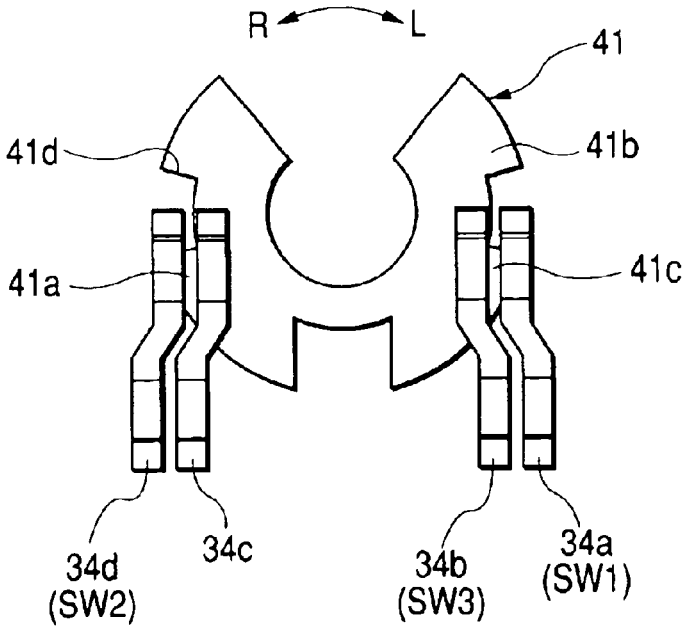
FIG. 9 is a schematic illustration for explaining a contacting action conducted between the electrode pattern on the rotary plate and the sliding piece in the device of the embodiment.

Referring to FIG. 9, explanations will be made into an action in which the operation member 15 is rotated together with the rotary plate 14 and the second sliding pieces 34*a*, 34*b*, 34*c*, 34*d* are contacted with the electrode pattern 41 on the rotary plate 14. First, when the operation member 15 is rotated to the left (in the direction or arrow L in FIG. 9), at the start of rotation, the second sliding piece 34*d* comes into contact with the electrode portion 41*a* of the electrode pattern 41 and forms a closed circuit of the first step together with the common sliding piece 34*c*. When the operation member 15 is further rotated in the same direction, the second sliding piece 34*a* comes into contact with the electrode portion 41*b* of the electrode pattern 41, and the second step circuit, which is composed of the sliding piece 34*d*, the sliding piece 34*a* and the common sliding piece 34*c*, is formed and the closed circuit of the first switch SW1 is composed. On the contrary, when the operation member 15 is rotated to the right (in the direction of arrow R in FIG. 9), at the start of rotation, the second sliding piece 34*a* comes into contact with the electrode portion 41*c* or the electrode pattern 41, and the closed circuit of the first step is composed together with the common sliding piece 34*c*. When the operation member 15 is further rotated, the second sliding piece 34*d* comes into contact with the electrode portion 41*d* of the electrode pattern 41, and the circuit of the second step, which is composed of the sliding piece 34*a*, the sliding piece 34*d* and the common sliding piece 34*c*, is formed and the closed circuit of the second switch SW2 can be composed. Therefore, according to the structure of this embodiment, for example, the rotating speed of an audio CD player can be set at two stages. When an electric signal generated in the first electric circuit is made to be the first rotating speed signal and an electric signal generated in the second electric circuit is made to be the second rotating speed signal which is twice as high as the first rotating speed, a strong and weak signal of the rotating speed can be generated by one rotating operation.

After the operation of the first switch SW1 or the second switch SW2 conducted by the rotation has been completed, the user pushes forward the operation member 15 in the sliding direction with the finger. When the operation member 15 is pushed, the operation member 15, the rotary plate 14 and the sliding member 13 elastically deform the arm portions 21*b* of the torsion coil spring 21 so that the arm portions 21*b* can be deflected, and the operation member 15, the rotary plate 14 and the sliding member 13 are integrally slid forward in the sliding direction guided by the engagement of the elliptical hole 36 with the support shaft 19. Due to this sliding movement, the second sliding piece 32*b* composing the switch SW3 comes into contact with the stationary contact point element 18*c*. The thus generated signal can be taken out as an operation signal of the switch SW3 via the stationary contact point element 18*c* and the stationary contact point element 18*d*. When the pushing conducted on the operation member 15 is released, the operation member 15, the rotary plate 14 and the slide member 13 are integrally, automatically returned to the rear in the sliding direction, that is, to the reference position. Further, the contact of the second sliding piece 32*a* with the stationary contact point element 18*d* can be released. Therefore, the third switch SW3 is opened.

Next, when the user pushes the operation portion 15*b* of the operating member 15 in the forward direction with the finger in a state in which the operation member 15 is located at the neutral position, the operating member 15 is tilted in the forward direction round the fulcrum of the engaging portion of the shaft portion 15*d* with the bearing groove portion 40. When the operating member 15 is tilted forward, the protruding portion 43 of the pushing operation portion 15*f* pushes down the fourth switch SW4, so that the circuit can be closed. After the operation of the fourth switch SW4 has been completed, a pushing force given to the operation portion 15*b* is released, and then the operation member 15 is returned to the neutral position by an elastic returning force of the torsion coil spring 21.

On the contrary, when the user pushes the operating portion 15*b* of the operation member 15 with the finger in the backward direction, the operation member 15 is tilted backward round the fulcrum of the engaging portion of the shaft portion 15*d* with the bearing groove portion 40. When the operation member 15 is tilted backward, the protruding portion 43 or the pushing operation portion 15*c* pushes down the fifth switch SW5, so that the circuit can be closed. After the operation of the fifth switch SW5 has been completed, the pushing force given to the operation portion 15*b* is released. Then, the operation member is returned to the neutral position by an elastic returning force of the torsion coil spring 21.

As described above, according to the composite operation type switch device 10 of the present embodiment, when the operation member 15 is rotated to the right or left, the first or the second switch SW1, SW2 is operated, when the operation member 15 is pushed in, the third switch SW3 is operated, and when the operation member 15 is tilted forward or backward, the fourth or the fifth switch SW4, SW5 is operated. In this way, one operation member 15 has five switching numbers.

Accordingly, in the compound operation type switch device composed as described above, one operation member 15 can switch five contact points. Therefore, when one operation member 15 is operated, various operations can be conducted. Accordingly, the compound operation type switch device of the present embodiment is advantageous in that the number of switches to be used is reduced so that the device can be downsized.

The compound operation type switch device of the present embodiment can provide the following advantages. When the operation member 15 is pushed in, the slide member 13 is slid integrally with the operation member 15, and the third switch SW3 is changed. When the operation member 15 is rotated to the right or left, the rotary plate 14 is rotated to the right or left in the sane manner as the operation member 15, and the first or the second switch SW1, SW2 is changed. Therefore, the composite operation type switch device of this embodiment is advantageous in that the rotating and pushing operation of the operation member 15 can be positively transmitted to the first, the second and the third switch SW1, SW2, SW3 via the slide member 13 or the rotary plate 14.

Further, the compound operation type switch device of the present embodiment can provide the following advantages. When the operation member 15 is tilted in the forward direction, one end side of the operation member 15 is pushed by the fourth switch SW4, so that the fourth switch SW4 can be changed. When the operation member 15 is tilted in the backward direction, the other end side of the operation member 15 is pushed by the fifth switch SW5, so that the fifth switch SW5 can be changed. Therefore, the fourth and the fifth switch SW4, SW5 can be smoothly changed.

Further, the compound operation type switch device of the present embodiment can provide the following advantages. When the slide member 13 is moved on the base 11, it is guided by the engagement of the support shaft 19 of the base 11 with the elliptical hole 36 of the slide member 13. Therefore, the slide member 13 can be smoothly moved on the base 11 in a predetermined sliding direction.

Further, the compound operation type switch device of the present embodiment can provide the following advantages. The pushing member capable of returning the operation member to the reference position at all times is composed of the torsion coil spring 21, the structure of which is simple and the manufacturing cost of which is low. Therefore, the compound operation type switch device of the present embodiment can be provided at a low price by reducing the manufacturing cost.

In the rotating operation to the right or left of the operation member 15, switching can be conducted to the first electric circuit which is formed by closing the sliding piece and the electrode pattern at the time of starting the rotation, and switching can be conducted to the second electric circuit, which is composed of the sliding piece, another sliding piece and the electrode pattern, when the rotation is further conducted in the same direction. Therefore, the two step (strong and weak) signal of the rotating speed can be generated by one rotating operation.

On the bottom face and the side of the containing portion 16 of the base 11, no gaps are provided so that flux can not intrude into the containing portion 16. Therefore, even when mounting is conducted with solder by the reflow soldering method, flux of the reflow solder can not intrude inside the containing portion 16. Accordingly, it is possible to provide a composite operation type switch device to which the reflow soldering method can be applied.

When the engaging pieces 12*b* provided on the cover 12 are slid along both sides of the base 11, the engaging holes 11 of the engaging pieces 12*b* are engaged with the engaging pawls 17 of the base 11. Due to this engagement, the cover 12 can be simply attached to the base 11 while the cover 12 is being prevented from coming out. Therefore, the assembling work can be simplified.

It should be noted that variations may be made by those skilled in that art without departing from the spirit and scope of the present invention.

What is claimed is:

1. A switch device, comprising:

a base member having a bottom wall;

an operation member, which is provided on the base member, and which conducts a rotating operation in a first direction and a second direction opposed to the first direction, a pushing operation in a third direction, and a tilting operation in forward and backward directions;

an urging member, which urges the operation member constantly so that the operation member is restored to a reference position;

a first and a second switches, which are operated by the rotating operation of the operation member in the first and second directions;

a third switch, which is operated by the pushing operation of the operation member; and a fourth and a fifth switches, which are operated by the tilting operation in the forward and backward direction of the operation member, wherein the first, second and third directions are parallel to the bottom wall surface of the base member; and wherein the forward and backward directions are substantially perpendicular to the bottom wall surface of the base member.

2. The switch device as set forth in claim 1, further comprising:

a slide member, which is slidably provided on the base member; and a rotary member, which is rotatably attached to the slide member, wherein the slide member slides on the base member with the rotary member when the pushing operation is conducted to change the third switch; and wherein the rotary member rotates with the operation member in the first and second directions when the rotary operation is conducted to change the first and second switches according to the rotating direction.

3. The switch device as set forth in claim 2, wherein the operation member has an intermediate portion which is rotatably and tiltably attached to the rotary member, the intermediate portion serving as a fulcrum when the operation member is tilted in the forward and backward direction;

wherein the intermediate portion has a first end portion and a second end portion which are located at both sides of the intermediate portion;

wherein when the operation member is tilted in the forward direction, the first end portion pushes the fourth switch so that the fourth switch is changed; and wherein when the operation member is tilted in the backward direction, the second end portion pushes the fifth switch so that the fifth switch is changed.

4. The switch device as set forth in claim 2, wherein the base member has a support shaft which is protruded upward;

wherein the slide member has a hole which extends in a sliding direction of the slide member; and wherein the support shaft is inserted into the hole.

5. The switch device as set forth in claim 2, wherein the urging member is provided as a torsion coil spring which has a winding portion and a pair of arm portions extending outside from the winding portion;

wherein the winding portion is attached to the rotary member from the above of the operation member; and wherein the pair of arm portions are fixed to the base member.

6. The switch device as set forth in claim 2, wherein an electrode pattern for the first and the second switches is provided on the rotary member;

wherein a sliding piece coming into contact with the electrode pattern is provided on the slide member;

wherein when the operation member is rotated to either the first direction or second direction, a changing operation is conducted between a first electric circuit formed at the time of starting rotation and a second electric circuit formed in a case that the operation member is further rotated in the same direction;

wherein the first electric circuit has the slide piece and the electric pattern; and wherein the second electric circuit has the slide piece, another slide piece and the electrode pattern.

7. The switch device as set forth in claim 2, wherein the base member has a containing portion in which a bottom face and side faces are closed and an upper face is open;

wherein the slide member, the rotary member, the operation member and urging member are contained in the containing portion;

wherein the upper face of the base member is closed so as to cover by a cover member except an operating portion of the operation member for conducting the rotating operation, the pushing operation and the tilting operation.

8. The switch device as set forth in claim 7, wherein the base member has a first engaging portion provided on a side face thereof;

wherein the cover member has a second engaging portion provided on a side edge thereof; and wherein the first engaging portion is engaged with the second engaging portion when the cover member is attached to the base member.

* * * * *